US006798311B2

(12) United States Patent
Hasegawa

(10) Patent No.: US 6,798,311 B2
(45) Date of Patent: Sep. 28, 2004

(54) NONRECIPROCAL CIRCUIT DEVICE WITH A SOLENOID-SHAPED INDUCTOR GENERATING PERPENDICULAR FLUX

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/726,710

(22) Filed: Nov. 30, 2000

(65) Prior Publication Data

US 2001/0019295 A1 Sep. 6, 2001

(30) Foreign Application Priority Data

Nov. 30, 1999 (JP) ..... 11-340423

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS

| | | | | |
|---|---|---|---|---|
| 3,836,874 A | * | 9/1974 | Maeda et al. | 333/1.1 |
| 4,236,125 A | * | 11/1980 | Bernard et al. | 333/1.1 |
| 5,923,224 A | * | 7/1999 | Makino et al. | 333/1.1 |
| 6,020,793 A | | 2/2000 | Makino et al. | 333/1.1 |

FOREIGN PATENT DOCUMENTS

| | | | | |
|---|---|---|---|---|
| EP | 0 903 802 A2 | * | 3/1999 | 333/1.1 |
| EP | 0948079 A1 | | 10/1999 | H01P/1/387 |
| JP | 50-132840 | | 10/1975 | |
| JP | 60-160606 | | 10/1985 | |
| JP | 5-95207 | | 4/1993 | |
| JP | 7-131209 | | 5/1995 | H01P/1/383 |
| JP | 10-79607 | | 3/1998 | H01P/1/383 |
| JP | 10-93308 | | 4/1998 | |
| JP | 0903801 A2 | * | 3/1999 | H01P/1/387 |
| JP | 11-97907 | | 4/1999 | |
| JP | 11-298207 | | 10/1999 | H01P/1/383 |

OTHER PUBLICATIONS

European Search Report dated Jul. 25, 2002, for application No. EP00126206.

Japanese Office Action No. 340423 dated Nov. 12, 2002, along with an English translation.

* cited by examiner

*Primary Examiner*—Stephen E. Jones
(74) *Attorney, Agent, or Firm*—Keating & Bennett, LLP

(57) ABSTRACT

To provide a nonreciprocal circuit device which is compact and capable of obtaining a large attenuation in a specified frequency band without increasing the cost, and provided with at least a built-in inductor for a filter, a nonreciprocal circuit constituted together with the nonreciprocal circuit device, and a communication device using the circuit, central conductors are disposed in a ferrite to which the DC magnetic field is applied in an intersecting manner with each other, matching capacitors are respectively connected between port sections of the central conductors and a ground to constitute a nonreciprocal circuit, a solenoid-shaped inductor is connected between the port section of the central conductor and a signal input/output terminal, and the inductor is disposed in a relationship so that the direction of the magnetic flux which is generated by this inductor and passes through the ferrite is substantially perpendicular to the direction of the DC magnetic field to the ferrite.

5 Claims, 9 Drawing Sheets

NONRECIPROCAL CIRCUIT DEVICE WITH A SOLENOID-SHAPED INDUCTOR GENERATING PERPENDICULAR FLUX

BACKGROUND OF THE INVENTION

1. Field of the Invention

The present invention relates to a nonreciprocal circuit device such as an isolator and a circulator for use in a high frequency bandwidth including a microwave band, a nonreciprocal circuit constituted together with the nonreciprocal circuit device, and a communication device using these components.

2. Description of the Related Art

Hitherto, nonreciprocal circuit devices such as a lumped constant isolator and a lumped constant circulator have been used for communication devices taking advantage of the characteristic that the attenuation of the signal is extremely small in the transmission direction, and extremely large in the reverse direction.

FIG. 7 is an exploded perspective view of a prior art isolator, FIGS. 8A and 8B are a top view and a cross-sectional view of its internal structure, and FIG. 9 is an equivalent circuit diagram, respectively.

As shown in FIGS. 7, 8A and 8B, in this isolator, a magnetic assembly 5 comprising central conductors 51, 52 and 53 and a ferrite 54, a permanent magnet 3 and a resin case 7 are disposed in a magnetic closed circuit mainly comprising a top yoke 2 and a bottom yoke 8. Port sections P1 and P2 of the central conductors 51 and 52 are connected to input/output terminals 71 and 72 and matching capacitors C1 and C2 formed in the resin case 7, a port section P3 of the central conductor 53 is connected to a matching capacitor C3 and a terminating resistor R, and each one end of the capacitors C1, C2 and C3 and one end of the terminating resistor R are connected to a ground terminal 73.

In an equivalent circuit shown in FIG. 9, the ferrite is expressed as a disc, the DC magnetic field as H, and the central conductors 51, 52 and 53 as an equivalent inductor L, respectively.

In a general communication device, an amplifier used in the circuit surely generates a certain distortion, causing the unwanted radiation such as second and third harmonic components of the fundamental wave. Since the unwanted radiation of the communication device causes an abnormal operation and radio interference of a power amplifier, and thus, the rules and standards are specified therefor in advance, and the level of the unwanted radiation must be below the specified value. In order to prevent the unwanted radiation, it is effective to use an amplifier with excellent linearity, but it is expensive, and a method in which a filter or the like is provided in place thereof to attenuate the unwanted frequency components is generally adopted. However, the use of such a filter is costly and the size of the communication device is increased, and losses by the filter are generated.

On the other hand, in the communication device, an isolator and a circulator are used for the stable operation and protection of an amplifier in the circuit, and in particular, the isolator and the lumped constant circulator have the characteristic of the band pass filter in the transmission direction characteristic that the signal is attenuated even in the transmission direction in the frequency band away from the pass band. However, in the nonreciprocal circuit device having only a prior art basic structure shown in FIGS. 7 to 9, no sufficient attenuation characteristic can be obtained in the unwanted frequency band.

A nonreciprocal circuit device capable of obtaining a large attenuation in the frequency band of the unwanted radiation such as mainly second and third harmonic components of the fundamental wave is shown in the Japanese Unexamined Patent Application Publication No. 10-93308, corresponding to U.S. Pat. No. 6,020,793. FIG. 10 is an exploded perspective view of the isolator, FIGS. 11A and 11B are a top view and a cross sectional view of its internal structure, and FIG. 12 is an equivalent circuit diagram, respectively as its constitution.

Difference of a device in FIGS. 10 to 11B from the prior art device in FIGS. 7 to 8B is that the inductor Lf for the band pass filter is provided. This inductor Lf is connected between the port section P1 of the central conductor 51, the matching capacitor C1 and the input/output terminal 71.

As shown in the equivalent circuit in FIG. 12, a band pass filter is constituted by this capacitor Cf and the inductor Lf by connecting the capacitor Cf to the input/output terminal 71 in series.

Thus, the whole communication device can be reduced in size compared with a case in which a single filter is installed outside by providing at least an inductor for the filter to attenuate the unwanted frequency band in the nonreciprocal circuit device. However, at the request for further reduction in size of the recent mobile communication equipment, the nonreciprocal circuit device itself provided with such an inductor for filter is also requested to be reduced in size. The inductor for filter must also be reduced in size. However, if the inductor formed in solenoid shape is reduced in size, its inductance is reduced, and the attenuation with second and third harmonic components of the fundamental wave is reduced. A structure in which a solenoid is formed within a magnetic member can be reasonably devised to reduce in size the solenoid-shaped inductor without reducing its inductance; however, in such a structure, there are problems that a magnetic member is newly required, its manufacture is not easy, and the cost is increased.

SUMMARY OF THE INVENTION

Accordingly, it is an object of the present invention to provide a nonreciprocal circuit device with at least an inductor for filter built therein which is compact and capable of obtaining a large attenuation in the specified frequency band without increasing the cost, a nonreciprocal circuit constituted together with the nonreciprocal circuit device, and a communication device using it.

In the nonreciprocal circuit device of the present invention comprising a plurality of central conductors overlappingly intersecting with each other and disposed on a magnetic member for receiving a DC magnetic field, a solenoid-shaped inductor is connected between at least one port section of the central conductors and a signal input/output terminal, and the inductor is disposed so that the direction of the magnetic flux generated by the inductor and passing through the magnetic member is substantially perpendicular to the direction of the DC magnetic field.

As shown in FIGS. 10 to 11B, in a prior art nonreciprocal circuit device, the magnetic flux generated by the inductor passes through the magnetic member (ferrite) in the direction parallel to the DC magnetic field; however, since the relative magnetic permeability in the direction parallel to the DC magnetic field of the magnetic member is 1, the inductor works only as the hollow core solenoid-shaped inductor. However, the relative magnetic permeability in the direction perpendicular to the DC magnetic field of the magnetic member is greater than 1, a substance high in relative magnetic permeability is interposed in the magnetic path of the inductor by the structure of the present invention, and the inductance of the inductor is increased. Thus, the inductor to obtain the specified inductance is reduced in size, and the whole nonreciprocal circuit device is reduced in size.

A nonreciprocal circuit of the present invention comprises the nonreciprocal circuit device and a capacitor connected to its inductor in series, and a band pass filter is formed of the capacitor and the inductor. The spurious such as second and third harmonic components of the fundamental wave is considerably attenuated thereby.

The nonreciprocal circuit of the present invention forms a low pass filter comprising capacitors connected between both ends of the inductor of the nonreciprocal circuit device and a ground, and the inductor. Unwanted frequency components are considerably attenuated thereby.

A communication device of the present invention is formed using the nonreciprocal circuit device or nonreciprocal circuit for, for example, a transmitting/receiving circuit of an antenna sharing circuit. A communication device compact and excellent in sprious characteristic is obtained.

According to the present invention, a substance high in relative magnetic permeability is interposed in the magnetic path of the inductor in the invention, the inductance of the inductor is increased, the inductor to obtain the specified inductance can be reduced in size, and the whole nonreciprocal circuit device can be reduced in size.

According to the present invention, the characteristic with both the nonreciprocal circuit characteristic and the band pass filter characteristic is obtained, the unwanted frequency component can be suppressed without separately providing any filter, and a device using this nonreciprocal circuit device can be reduced in size.

According to the present invention, the device can be reduced in size while suppressing the unwanted radiation from the device.

DESCRIPTION OF THE PREFERRED EMBODIMENTS

Figure 1:
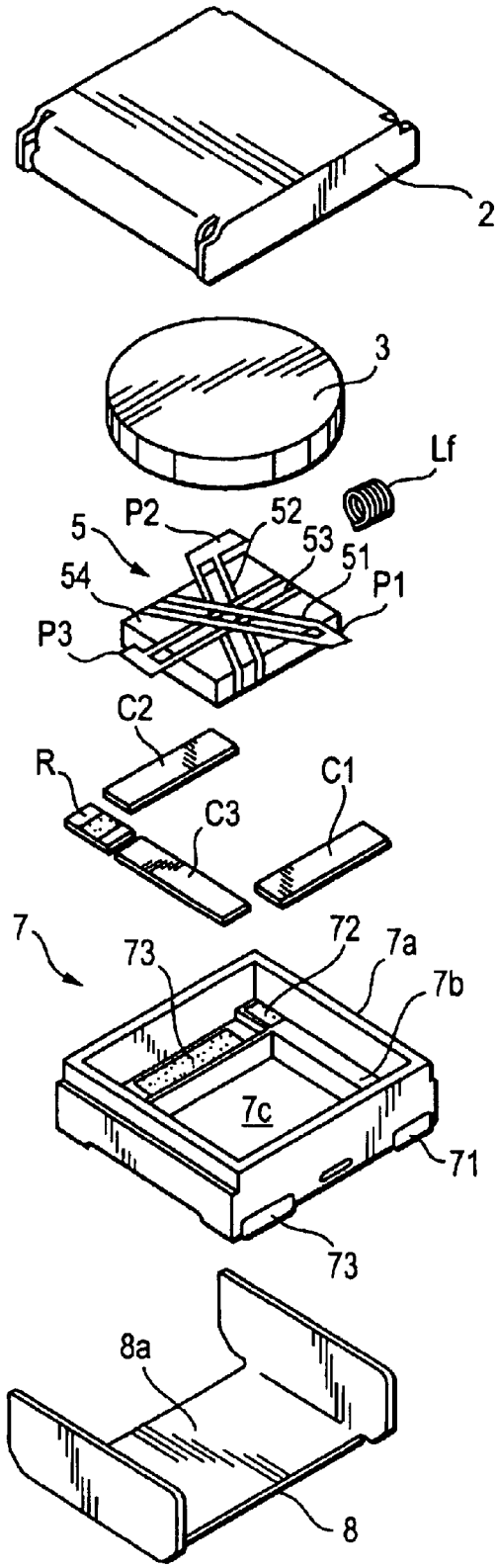
FIG. 1 is an exploded perspective view of an isolator of a first embodiment.
Figure 2A:
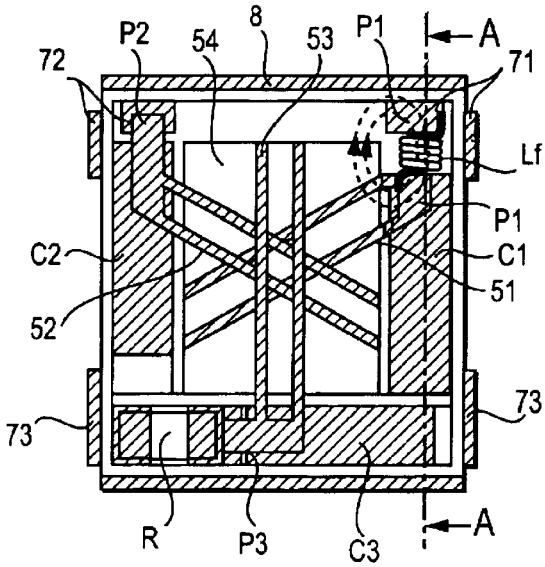
FIG. 2A is a top plan view of the isolator with a top yoke removed therefrom.

The constitution of an isolator of the first embodiment is described below with reference to FIGS. 1 to 3. FIG. 1 is an exploded perspective view of the isolator, and FIG. 2A is a top plan view thereof and FIG. 2B is a cross sectional view taken along the line A—A of FIG. 2A.

Figure 2B:
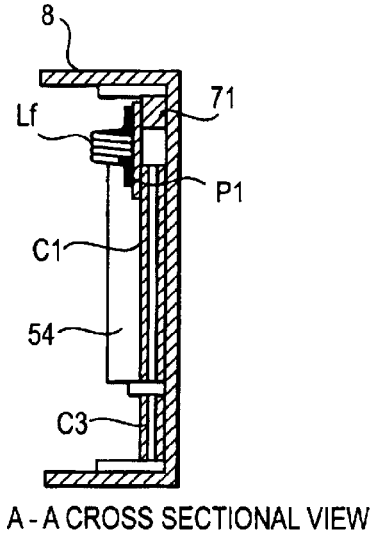
FIG. 2B is a cross sectional view taken along the line A—A of FIG. 2A.

As shown in FIGS. 1 to 2B, in this isolator, a disc-shaped permanent magnet 3 is disposed on an inner surface of a box-like top yoke 2 formed of a magnetic metal as shown in FIGS. 1 and 2, a closed magnetic circuit is formed of this top yoke 2 and a substantially U-shaped bottom yoke 8 similarly formed of a magnetic metal, a resin case 7 is disposed on a bottom surface 8*a* in the bottom yoke 8, and a magnetic assembly 5, matching capacitors C1, C2 and C3, a terminating resistor R and an inductor Lf are disposed in the resin case 7.

In the magnetic assembly 5, a ground part common to three central conductors 51, 52 and 53 of the same shape as that of a bottom surface of a ferrite 54, is abutted on the lower surface of the ferrite 54 of rectangular parallelepiped plate shape. The three central conductors 51, 52, 53 extending from the ground part are disposed on an upper surface of the ferrite 54 such that the three central conductors are folded so as to form an angle of 120 degrees between each other with an insulation sheet (not shown in the figure) interposed therebetween. Port sections P1, P2 and P3 on each forward end side of the central conductors 51, 52 and 53 are projected outwardly. The DC magnetic field is applied to this magnetic assembly 5 by the permanent magnet 3 so that the magnetic flux passes the ferrite 54 in its thickness direction.

The resin case 7 is formed of an electric insulation material, a bottom wall 7*b* is integrated with a side wall 7*a* of rectangular frame shape, and input/output terminals 71 and 72 and a ground terminal 73 are provided such that a part thereof are embedded in a resin. A through hole 7*c* is formed in a center portion of the bottom wall 7*b*, and the magnetic assembly 5 is inserted and disposed in this through hole 7*c*. The ground part of the central conductors 51, 52 and 53 on the lower surface of this magnetic assembly 5 is connected to a bottom surface 8*a* of the bottom yoke 8 by soldering, etc. The input/output terminals 71 and 72 are disposed on both corner portions on one side surface of the resin case 7, and the ground terminals 73 and 73 are disposed on both corner portions on the other side surface. One end of these input/output terminals 71 and 72, and the ground terminals 73, 73 is respectively provided so as to be exposed to the upper surface of the bottom wall 7*b*, and the other end thereof is respectively provided so as to be exposed to the lower surface of the bottom wall 7*b* and the outer surface of the side wall 7*a*.

The chip-like matching capacitors C1, C2 and C3, the chip-like terminating resistor R and the inductor Lf forming a part of the band pass filter are disposed on a peripheral edge of the through hole 7*c*. Lower surface electrodes of the capacitors C1, C2 and C3 and an electrode on one end side of the terminating resistor R are connected to the ground terminals 73, 73, respectively. The port sections P1, P2 and P3 of the central conductors 51, 52 and 53 are connected to upper surface electrodes of the capacitors C1, C2 and C3, and the other end side of the terminating resistor R is connected to the port section P3. The port sections P1, P2 and P3 are shaped in a step so that the port sections P1, P2 and P3 are on the level of the upper surfaces of the capacitors C1, C2 and C3, respectively.

The inductor Lf shown in FIGS. 1 to 2B, are formed of a copper wire of 0.1 mm in diameter and has eight turns of 0.8 mm in outside diameter, and its inductance when no ferrite is present is set to approximately 24 nH. This copper wire is covered with an insulation film made of polyimideamide, polyesterimide, polyester, or polyimide which are excellent in heat resistance, and the windings are electrically insulated. A copper portion of its terminal part is exposed, one end side is connected to the port section P1 of the central conductor 51, and the other end side is connected to the input/output terminal 71. This means that the port section P1 is connected to the input/output terminal 71 via the inductor Lf.

As shown in FIG. 2A, both ends of the inductor Lf are disposed so as not to be on one line to increase the stability in soldering the port section P1 and the input/output terminal 71 and improve the productivity. Both ends of this inductor Lf are led so that the height of the axis of the solenoid of the inductor is substantially equal to a position of the center height of the ferrite 54. In addition, the inductor Lf is disposed so that its axis is extended in the surface direction of the ferrite 54, that is, in the direction perpendicular to the direction of the DC magnetic field by the permanent magnet 3. Thus, the magnetic flux by the inductor Lf passes in the direction perpendicular to the direction of the DC magnetic field with respect to the ferrite 54 as indicated by an arrow of broken line in FIG. 2. The magnetic permeability of the ferrite 54 is a tensor magnetic permeability, and the component in the direction parallel to the DC magnetic field by the permanent magnet 3 is 1 in relative magnetic permeability, which is same as that in vacuum. On the other hand, the relative magnetic permeability in the direction perpendicular to the direction of the DC magnetic field is approximately 2 to 3. Therefore, the inductance of the inductor Lf is greater than the value in the case in which the axis of the inductor is disposed in the direction perpendicular to the surface of the ferrite 54.

Figure 12:
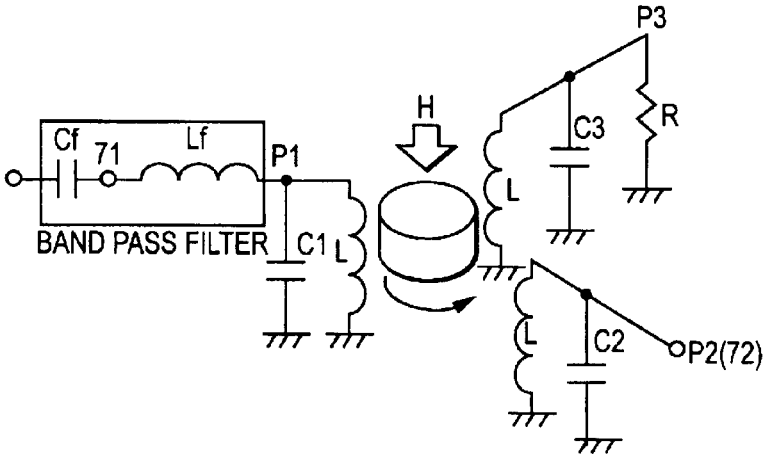
FIG. 12 PRIOR ART
FIG. 12 is an equivalent circuit diagram of the isolator.

In a condition in which the isolator is mounted on a mounting board, a capacitor Cf is connected to the input/output terminal 71 of the isolator. A band pass filter is formed by the capacitor Cf together with the inductor Lf as shown in FIG. 12.

The isolator of the present embodiment is miniaturized component of substantially 7.0 mm in width, 7.0 mm in depth and 2.0 mm in height, and, for example, in the 1.5 GHz band, the electrostatic capacitance of the matching capacitors C1, C2 and C3 is set to approximately 5 pF, the electrostatic capacitance of the capacitor Cf for filter is set to approximately 0.5 pF, and the inductance of the inductor Lf is set to approximately 20 nH, respectively, while, in the 900 MHz band, the electrostatic capacitance of the matching capacitors C1, C2 and C3 is set to approximately 10 pF, the electrostatic capacitance of the capacitor Cf is set to approximately 1.0 pF, and the inductance of the inductor Lf is set to approximately 30 nH, respectively.

Figure 3:
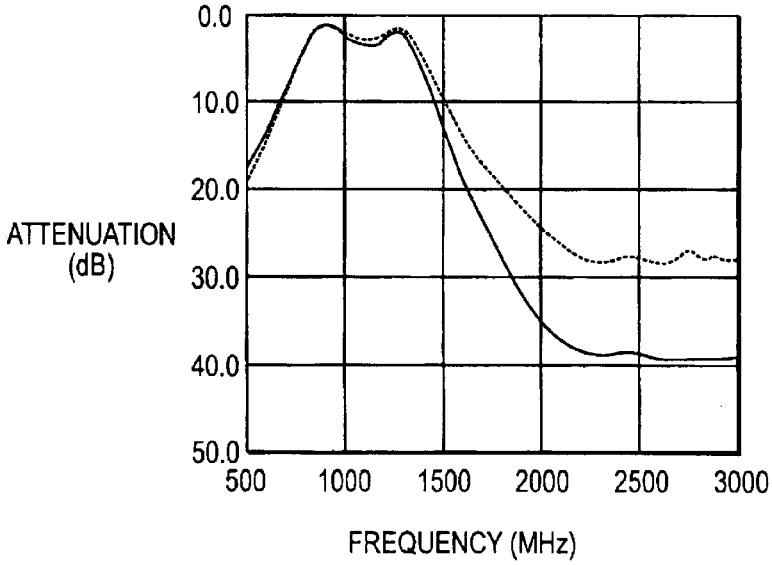
FIG. 3 is a graph showing the frequency characteristic of the attenuation of the isolator and a prior art isolator.

FIG. 3 shows the attenuation characteristic in the transmission direction of the isolator when the capacitor to constitute the band pass filter together with the inductor Lf is connected to the input/output terminal 71 of the isolator. In FIG. 3, a solid line shows the characteristic of the isolator of the present embodiment while a broken line shows the isolator without the inductor Lf and the capacitor. If the frequency of the fundamental wave is assumed to be 900 MHz, the attenuation of the second harmonic component is approximately 19 dB, and the attenuation of the third harmonic component is approximately 28 dB when the band pass filter is not provided, while according to the present embodiment the attenuation of the second harmonic component is approximately 28 dB, and the attenuation of the third harmonic component is approximately 40 dB, and thus a larger attenuation can be obtained by the present embodiment.

Figure 10:
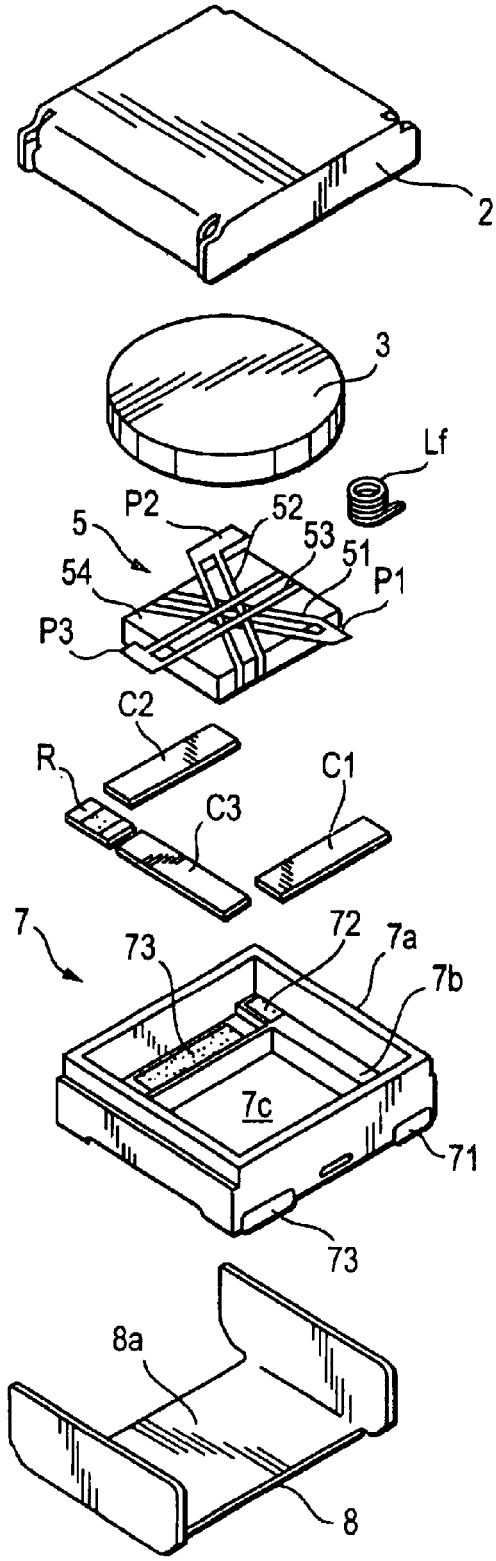
FIG. 10 PRIOR ART
FIG. 10 is an exploded perspective view of another prior art isolator.
Figure 11A:
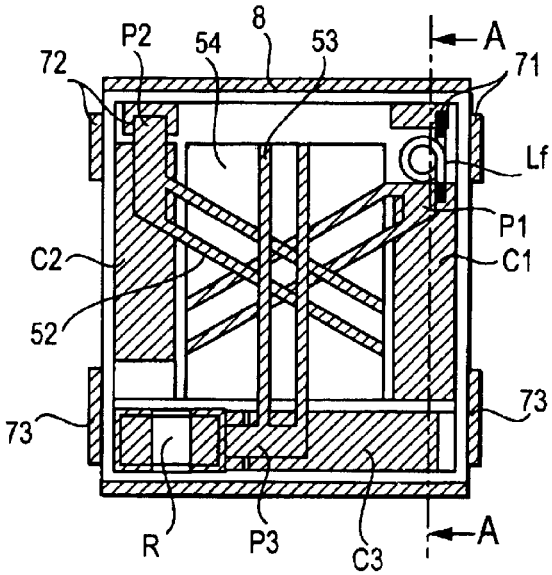
FIG. 11A PRIOR ART
FIG. 11A is a top plan view of the isolator with a top yoke removed therefrom.
Figure 11B:
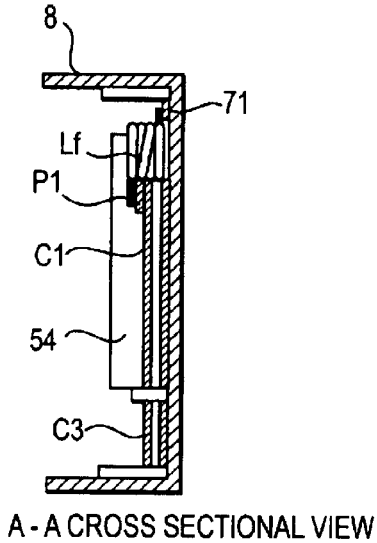
FIG. 11B PRIOR ART
FIG. 11B is a cross sectional view taken along the line A—A of FIG. 11A.

If the characteristic indicated by the solid line in FIG. 3 is obtained by a prior art structure shown in FIGS. 10 and 11, nine turns would be required with the diameter of the copper wire and the outside diameter of the isolator unchanged. In other words, the dimension in the thickness direction of the isolator can be reduced by the present embodiment, and the isolator can be reduced in size.

Figure 4:
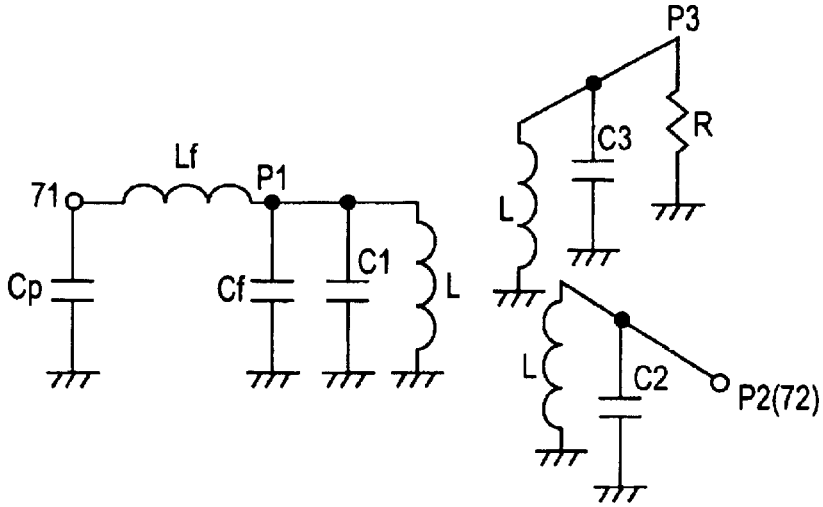
FIG. 4 is a view of the constitution of a nonreciprocal circuit using the isolator of a second embodiment.

In the above-described example, the band pass filter is constituted by the inductor Lf provided inside the isolator and the capacitor Cf externally connected in series to the input/output terminal for the equivalent circuit as shown in FIG. 12; however, alternatively, a nonreciprocal circuit having the low pass characteristic may be constituted by forming a low pass filter using the inductor Lf. FIG. 4 shows the equivalent circuit in such a case, where no ferrite is shown, and symbol Lf denotes the inductor similarly provided to the embodiment. Symbol Cf denotes a part of the matching capacitor C1, and separately shown from C1 in the equivalent circuit for convenience. Thus, in reality, the capacitance value of the matching capacitor C1 to which a port section P1 of the first central conductor is connected is actually set to the value in which the capacitance Cf for filter is added to the electrostatic capacitance originally necessary for matching. Symbol Cp is the distributed capacitance generated between an electrode on the mounting substrate to which the input/output terminal 71 is connected and a ground. The π-type low pass filter comprise Lf, Cp and Cf. For example, in the 1.5 GHz band, the capacitors Cf and Cp are respectively, set to approximately 1.5 pF, and the inductor Lf is set to approximately 5 nH, and in the 900 MHz band, Cf and Cp are set to approximately 2 pF, respectively, and the inductor Lf is set to approximately 8 nH. Cp may be formed of chip component.

Figure 5A:
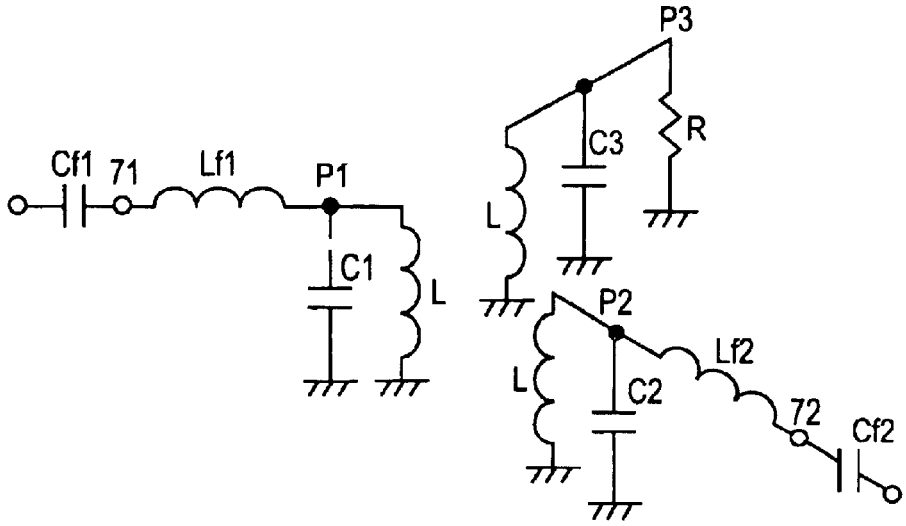
FIG. 5A is an equivalent circuit diagram of a constitution of a nonreciprocal circuit using the isolator of a third embodiment.
Figure 5B:
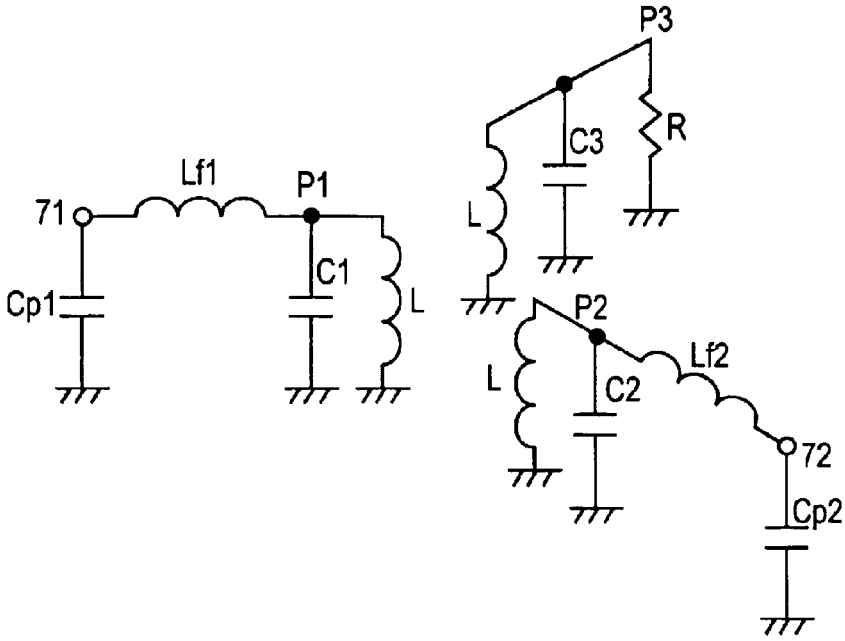
FIG. 5B is an equivalent circuit diagram of another constitution of the nonreciprocal circuit using the isolator of the third embodiment.

An example of a nonreciprocal circuit of a third embodiment with reference to FIGS. 5A and 5B. In the above-described embodiment, the band pass filter or the low pass filter is disposed on an input port section of the isolator, and a similar filter may be disposed similarly on an output port section. FIGS. 5A and 5B show an equivalent circuit in which indication of the ferrite is omitted. In an example in FIG. 5A, inductors Lf1 and Lf2 are connected between port sections P1 and P2 of first and second central conductors, and input/output terminals 71 and 72, respectively. Capacitors Cf1 and Cf2 are externally connected to input/output terminals 71 and 72 of the isolator, to constitute a first band pass filter defined by Lf1 and Cf1, and constitute a second band pass filter defined by Lf2 and Cf2. A nonreciprocal circuit having two stages of band pass filters is formed. Thereby large attenuation in the elimination band can be obtained.

In an example shown in FIG. 5B, inductors Lf1, Lf2 are similarly connected between ports P1 and P2 of first and second central conductors, and input/output terminals 71 and 72. Capacitors Cp1 and Cp2 by the distributed capacitance are provided between the input/output terminals 71 and 72 and the ground, respectively. A π-type low pass filter is disposed on the input port side and the output port side, respectively. Also in this case, the nonreciprocal circuit has a two-staged low pass filter, and large attenuation can be gained in the elimination band.

A band pass filter or a low pass filter may be disposed not on the input port side of the isolator but on the output port side only.

Figure 6:
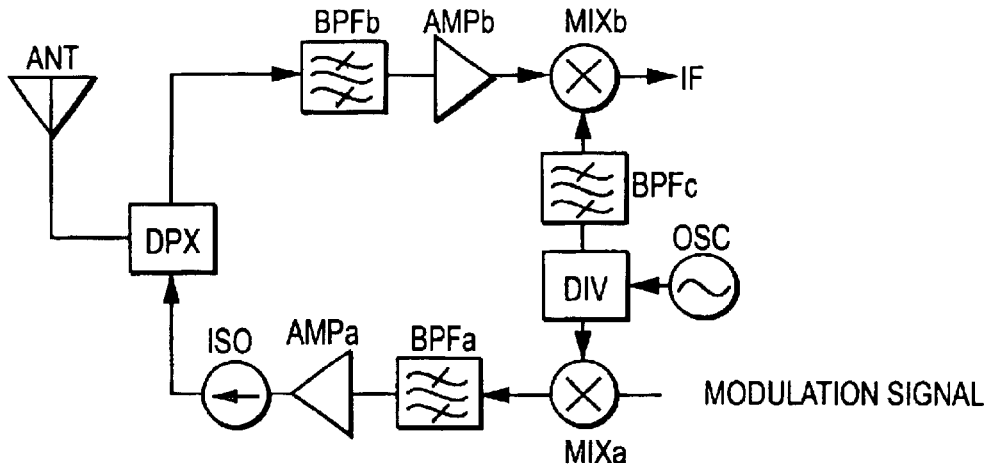
FIG. 6 is a block diagram of the constitution of a communication device of a fourth embodiment.
Figure 7:
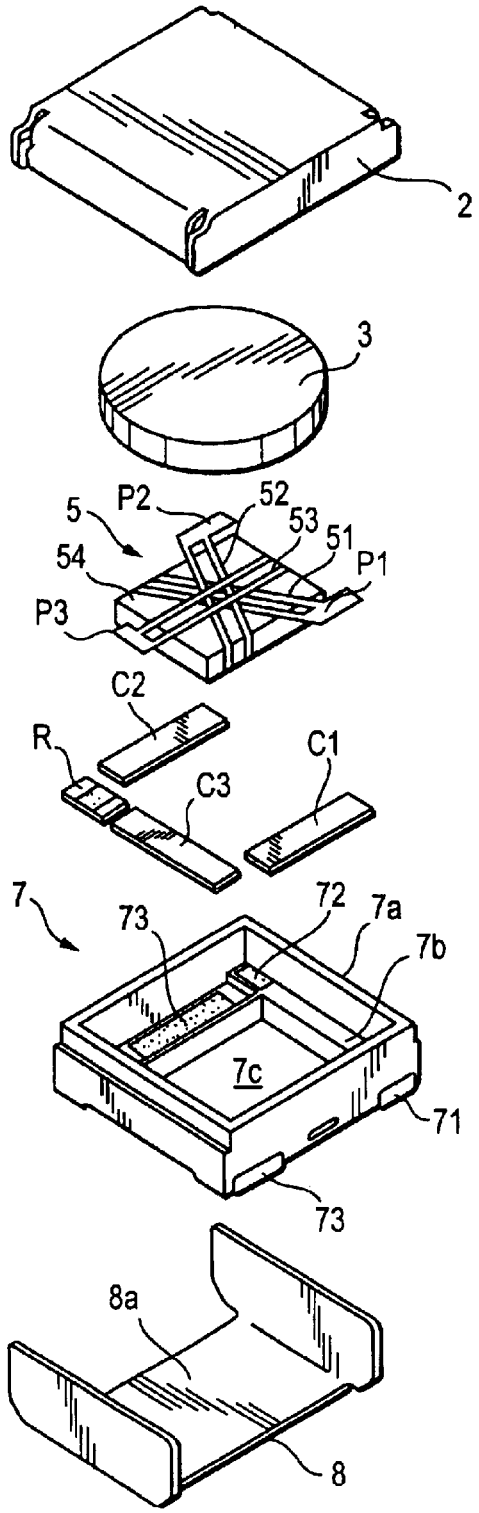
FIG. 7 PRIOR ART
FIG. 7 is an exploded perspective view of a prior art isolator.
Figure 8A:
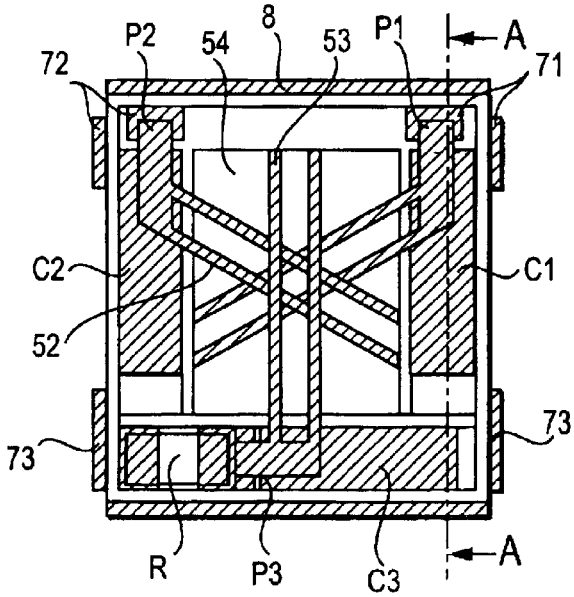
FIG. 8A PRIOR ART
FIG. 8A is a top plan view of the isolator with a top yoke removed therefrom.
Figure 8B:
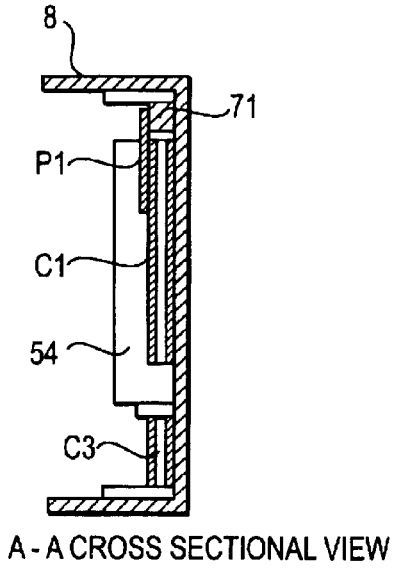
FIG. 8B PRIOR ART
FIG. 8B is a cross sectional view taken along the line A—A of FIG. 8A.
Figure 9:
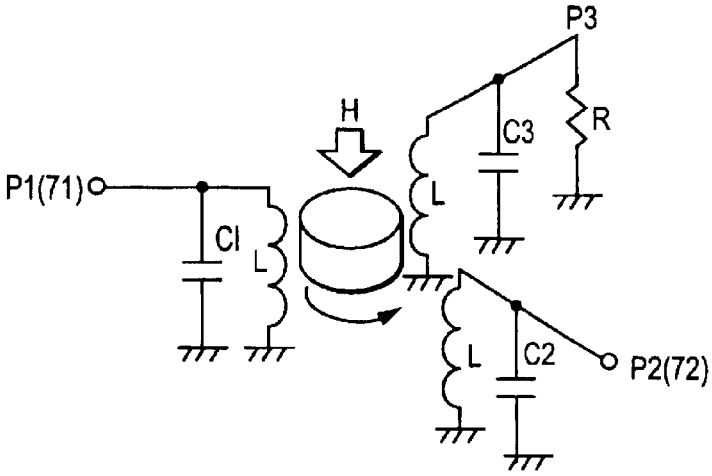
FIG. 9 PRIOR ART
FIG. 9 is an equivalent circuit diagram of the isolator.

An embodiment of a communication device using the isolator will be described below with reference to FIG. 6. In the figure, symbol ANT denotes a transceiver-receiver antenna, symbol DPX denotes a duplexer, symbols BPFa, BPFb and BPFc denote a band pass filter, symbols AMPa and AMPb denote an amplifier, symbols MIXa and MIXb denote a mixer, symbol OSC denotes an oscillator, and symbol DIV denotes a power divider. MIXa modulates the frequency signal outputted from DIV by the modulation signal, BPFa passes only the band of the transmission frequency, AMPa amplifies it in power, and ANT transmits it through the isolator ISO and DPX. BPFb passes only the reception frequency band of the signal supplied from DPX, and AMPb amplifies it. MIXb mixes the frequency signal outputted from BPFc with the reception signal to output the intermediate frequency signal IF.

Devices and circuits shown in FIGS. 1 to 5 are used for the isolator ISO. Since this isolator ISO has the band pass characteristic and the low pass characteristic, the band pass filter BPFa to pass only the transmission frequency band may be omitted. A communication device completely reduced in size is thus constituted.

In the above-described embodiment, description is made with the isolator as an example; however, the present invention can be similarly applied to a circulator with the port section P3 as a third I/O part without connecting any terminating resistor R to the port section P3 of a third central conductor.

In the embodiment, description is made with a hollow core solenoid as the inductor Lf; however, a conductive wire may be coiled around a dielectric body or a magnetic body in a solenoid shape, or a solenoid-shaped conductor pattern may be formed. Alternatively, an electrode is built in the dielectric body or the magnetic body in the solenoid shape. Even with such structures, the inductance of the inductor is increased by disposing the inductor so that the magnetic flux is passed in the direction perpendicular to the DC magnetic field with respect to the magnetic member (ferrite) to be coupled with the central conductor, and the device can be reduced in size on the whole.

In addition, this invention is not limited to the whole structure shown in FIGS. 1 and 2, but may be a structure in which a central conductor is formed inside a multi-layered substrate.

What is claimed is:

1. A nonreciprocal circuit device comprising:

a plurality of central conductors overlappingly intersecting with each other and disposed on a magnetic member for receiving a DC magnetic field; and a coiled-shaped inductor connected at its ends to at least one portion section of said central conductors and to a signal input/output terminal, respectively; wherein said magnetic member has a substantially rectangular shape with four edge surfaces;

a longitudinal axis of said inductor is parallel to a major surface of said magnetic member;

said major surface of said magnetic member is perpendicular to a direction of said DC magnetic field;

a magnetic flux produced by said inductor passes in a direction that is perpendicular to the direction of said DC magnetic field with respect to said magnetic member; and both ends of said inductor are parallel to said longitudinal axis of said inductor; and said both ends are not disposed in a straight line.

2. A nonreciprocal circuit device according to claim 1, wherein said inductor is disposed with an axis of said inductor substantially adjacent to a central plane of the magnetic member.

3. A nonreciprocal circuit comprising:

a nonreciprocal circuit device according to claim 1; and capacitors connected between both ends of the inductor of said nonreciprocal circuit device and a ground, wherein a low pass filter comprises said capacitors and said inductor.

4. A nonreciprocal circuit device comprising:

a nonreciprocal circuit device according to claim 1; and a capacitor connected in series to the inductor of said nonreciprocal circuit device, wherein a band pass filter comprises said capacitor and said inductor.

5. A communication device comprising the nonreciprocal circuit device according to claim 1, or the nonreciprocal circuit according to one of claims 4 and 3.

* * * * *